US007117644B2

(12) United States Patent
Dehart

(10) Patent No.: US 7,117,644 B2
(45) Date of Patent: Oct. 10, 2006

(54) MODULAR SENTRY STATION

(75) Inventor: Jim Dehart, Moyock, NC (US)

(73) Assignee: Blackwater Target Systems LLC, Moyock, NC (US)

( * ) Notice: Subject to any disclaimer, the term of this patent is extended or adjusted under 35 U.S.C. 154(b) by 0 days.

(21) Appl. No.: 10/428,141

(22) Filed: May 2, 2003

(65) Prior Publication Data

US 2006/0185260 A1 Aug. 24, 2006

Related U.S. Application Data

(60) Provisional application No. 60/376,846, filed on May 2, 2002.

(51) Int. Cl.
*E04B 2/00* (2006.01)

(52) U.S. Cl. ..... 52/36.1; 52/79.2; 52/65; 52/106; 52/239; 52/79.5

(58) Field of Classification Search ..... 52/36.1, 52/36.2, 79.2, 65, 106, 239, 236.9, 582.1, 52/587.1, 586.2, 585.1, 591.4, 79.1, 79.5; 109/15, 9, 10, 11, 12, 17, 49.5, 58, 78, 79, 109/80, 81, 82, 83, 84, 85
See application file for complete search history.

(56) References Cited

U.S. PATENT DOCUMENTS

| | | | | |
|---|---|---|---|---|
| 728,471 | A * | 5/1903 | Kulhanek | 52/206 |
| 2,600,900 | A * | 6/1952 | McNeill | 446/110 |
| 3,477,184 | A * | 11/1969 | Johnson et al. | 52/105 |
| 3,694,974 | A * | 10/1972 | Eckel | 52/36.2 |
| 5,437,573 | A * | 8/1995 | Rodriguezferre | 472/116 |
| 5,711,231 | A * | 1/1998 | Couvrette et al. | 109/2 |
| 5,890,338 | A * | 4/1999 | Rodriguez-Ferre | 52/582.1 |
| 6,070,372 | A * | 6/2000 | Norman et al. | 52/71 |
| 6,205,716 | B1 * | 3/2001 | Peltz | 52/36.2 |
| 6,675,538 | B1 * | 1/2004 | Candio | 52/65 |

* cited by examiner

*Primary Examiner*—Brian E. Glessner
*Assistant Examiner*—Basil Katcheves
(74) *Attorney, Agent, or Firm*—Nixon Peabody LLP; Donald R. Studebaker

(57) ABSTRACT

A modular sentry station uses stackable interlocking panels that when assembled provide a ballistic shield. The sentry station can optionally include interlocking ceiling and floor panels that provide a partially enclosed, bunker-type ballistic shield.

21 Claims, 4 Drawing Sheets

MODULAR SENTRY STATION

RELATED APPLICATION DATA

This application claims the benefit of and priority under 35 U.S.C. §119(e) to U.S. Patent Application Ser. No. 60/376,846, filed May 2, 2002, entitled "Portable and Scalable Sentry Station," which is incorporated herein by reference in its entirety.

BACKGROUND OF THE INVENTION

Field of the Invention

This invention relates to ballistic protection devices. In particular, this invention relates to a portable, modular sentry station, such as a bunker.

Sentry stations come in a variety of different sizes, shapes and materials. For example, one of the most economical and most versatile types of sentry station is based on the traditional approach of assembling walls of sand bags around the perimeter of an area to be protected. An alternative, or in conjunction with the sand bag barrier, is to excavate a portion of land to create a bunker that provides both protection from incoming ballistics via the sand bags as well as by virtue of the bunker being partially subterranean.

SUMMARY OF THE INVENTION

While existing systems tend to provide adequate protection, they are not always portable, scalability can be difficult to achieve based on the availability of resources in the surrounding environment, e.g. the amount of sand, and their effectiveness is not always uniform.

An exemplary embodiment of the present invention provides a modular sentry station. This modular sentry station is expandable through the use of stackable interlocking panels. Furthermore, the sentry station can optionally include interlocking ceiling and floor panels that provide a partially enclosed, bunker-type ballistic shield.

In particular, the modular sentry station includes a plurality of panels that optionally include one or more gun ports and can optionally have an attaching mechanism for attaching a facade, such as camouflage, wood, or the like, to for example, facilitate the modular sentry station's blending into a local environment. The modular sentry station could also be painted. Additionally, the interlocking panels are stackable to facilitate portability and further include an interlocking mechanism such that, when attached, create a V-shaped wall. Furthermore, due to this V-shaped structural arrangement, the modular sentry station can be self supporting with out the necessity of having supplemental footings or support members.

Aspects of the present invention relate to a ballistic barrier. In particular, aspects of the present invention relate to a sentry station.

Aspects of the present invention further relate to a modular sentry station that is disassemblable.

Aspects of the present invention further relate to a modular sentry station whose components are scalable.

Furthermore, aspects of the present invention relate to a modular V-shaped wall device capable of blocking incoming ballistics.

Additional aspects of the invention relate to a modular bunker having one or more gun ports.

These and other features and advantages of this invention are described in or are apparent from the following detailed description of the embodiments.

BRIEF DESCRIPTION OF THE DRAWINGS

The embodiments of this invention will be described in detail, with reference to the following figures, wherein.

DETAILED DESCRIPTION OF THE INVENTION

Figure 1:
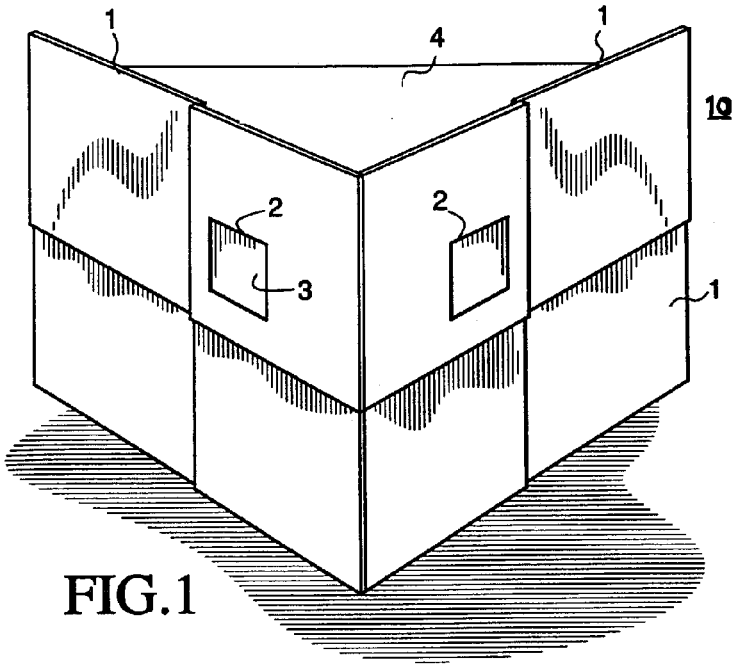
FIG. 1 is a front-side perspective view of an exemplary modular sentry station according to this invention.
Figure 2:
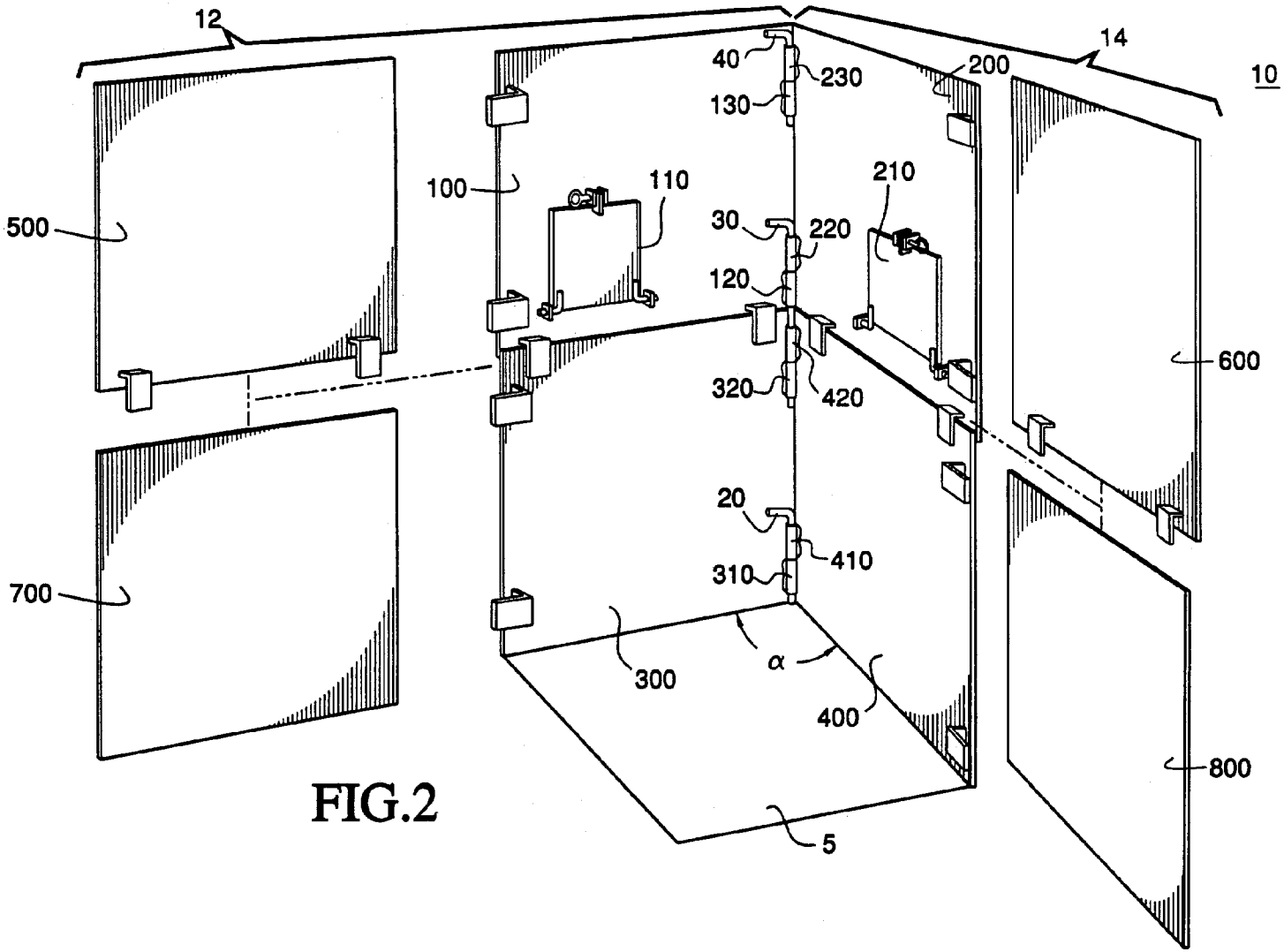
FIG. 2 is a back-side perspective view of an exemplary modular sentry station according to this invention.

FIG. 1 illustrates an exemplary modular sentry station 10 according to this invention. In particular, the modular sentry station 10 comprises a number of panels 1 that are capable of being assembled in an interlocking manner such that a wall or perimeter can be formed. This wall or perimeter can be used, for example, as a ballistic shield. The modular sentry station 10 further comprises one or more ports 2 that can be closed via a door mechanism 3. Through various types of interlocking mechanisms, the modular sentry station 10 can take on a variety of shapes from substantially planar to a V-shaped structure. Furthermore, an optional roof member 4 can be adapted to interlock with the upper panels 1. Additionally, as illustrated in FIG. 2, the modular sentry station 10 optionally includes a floor element 5 that optionally interlocks with one or more of the panels.

The exemplary systems and methods of this invention will be described in relation to a modular sentry station. However, to avoid unnecessarily obscuring the present invention, the following description omits well-known structures and devices that may be shown in a summarized form. For the purposes of explanation, numerous specific details are set forth in order to provide a thorough understanding of the present invention. It should be however appreciated that the present invention may be practiced in a variety of ways beyond the specific details set forth herein.

For example, while the present will be described in relation to a singular modular sentry station having, in general, a V-shaped structure, it is to be appreciated that the modular sentry station can be combined with one or more other modular sentry stations using the same basic interlocking mechanisms discussed herein to further expand the protection afforded by the unit. Furthermore, it should be appreciated that while the exemplary embodiment is illustrated as having substantially flat panels with interlocking mechanisms attached thereto, other sizes and shapes of panels could also be used with out affecting the operability of the system. Additionally, while the panels are preferably constructed of steel such as AR500 steel, it should be appreciated that other types of steels, compositions and combinations of materials can be used. For example, the panels could be a multilayered material that could include carbon fiber or Kevlar®.

Furthermore, the modular sentry station 10 can comprise one or more closable openings, such as gun ports, that provide, for example, a portal from which to discharge a firearm. Additionally, as previously discussed, the modular sentry station 10 can comprise a roof member 4 that covers a portion of the station. Likewise, the modular sentry station 10 can comprise a floor element 5 that generally extends between and covers a portion between the panels that form the walls.

FIG. 2 illustrates in greater detail the interlocking mechanisms used for the modular sentry station 10. In particular, the modular sentry station 10 comprises a first ported panel 100, a second ported panel 200, a third panel 300, a fourth panel 400, panels 500 and 600, and panels 700 and 800. While the exemplary embodiment illustrates the various panels assembled in a particular order, it is to be appreciated that various configuration and locations of the panels can be adjusted and varied based on, for example, a particular environmental or other need. The first ported panel 100 comprises a port 110 and at least one receiver, such as receiver 120 and receiver 130. Ported panel 200 comprises a port 210 and at least one receiver, such as receiver 220 and receiver 230. In the present exemplary embodiment, the receivers align with one another to allow receipt of pins 30 and 40 thereby interlocking the ported panel 100 and the ported panel 200. However, it should be appreciated, that the receiver 230 could be replaced by pin, or other interlocking mechanism. For example, ported panel 200 could alternatively have a fixed pin (not shown) that is adapted to be placed in the receiver 130. Likewise, panel 300 comprises one or more receivers, such as receiver 310 and receiver 320. Panel 400 comprises also comprises one or more receivers, such as receiver 410 and receiver 420. However, it should be appreciated, that the receiver 410 could be replaced by pin, or other interlocking mechanism, that cooperates with receiver 310.

In operation, panel 300 is placed in the vicinity of panel 400 such that, for example, pin 20 is placed in receiver 410 and receiver 310. Alternatively as previously discussed, receiver 410 can be replaced with, for example, a pin (not shown) that is affixed to panel 400 and that is placed in receiver 310. Next, ported panel 100 and ported panel 200 are respectively interlocked with panel 300 and panel 400 in such a manner that a V-shaped wall is formed. Next, pin 40 is placed in receiver 230 and receiver 130 and pin 30 is placed in receiver 120, receiver 220, receiver 420 and receiver 320. Thus, in accordance with this exemplary embodiment, a pivotal hinge is created through the use of the pins 20, 30, and 40 and their corresponding receivers.

Next, panels 700 and 800 are interlocked with panels 300 and 400. Then panels 500 and 600 are interlocked with panels 700 and 800, and panels 100 and 200, respectively.

As previously discussed, the number of panels comprising the modular sentry station 10 can be varied depending on any number of circumstances. Furthermore, it should be appreciated that the panels can be rotated into different orientations thereby allowing different configurations and shapes of the modular sentry station.

Furthermore, the plurality of panels when interlockably connected create two substantially planar larger panels 12 and 14 as illustrated in FIG. 2. The angle between the these panels can be varied due to the nature of the pivotal hinge formed by the receivers and pins previously described thereby allowing the modular sentry station to be self supporting.

Additionally, the various panels can be further secured together though the use of supplemental pins and receivers or comparable securing mechanisms to prevent, for example, the panels from separating under heavy fire. For example, the securing mechanisms could include eyelets, fasteners, holes and corresponding fasteners, an interlocking slot mechanism, parallel elongated sleeves, a spring loaded locking mechanism, or other suitable engagement device.

Figure 4:
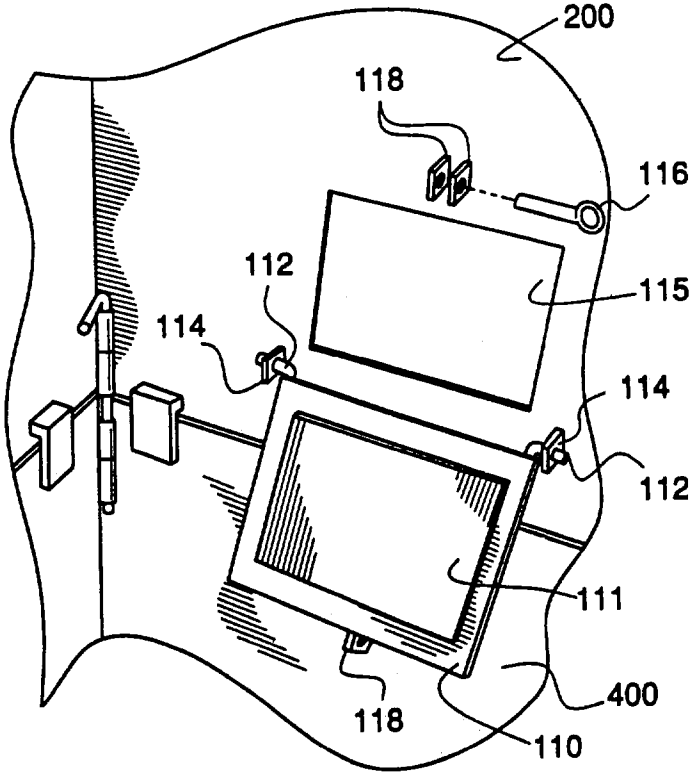
FIG. 4 is a detailed view of an exemplary ported panel according to this invention.
Figure 3:
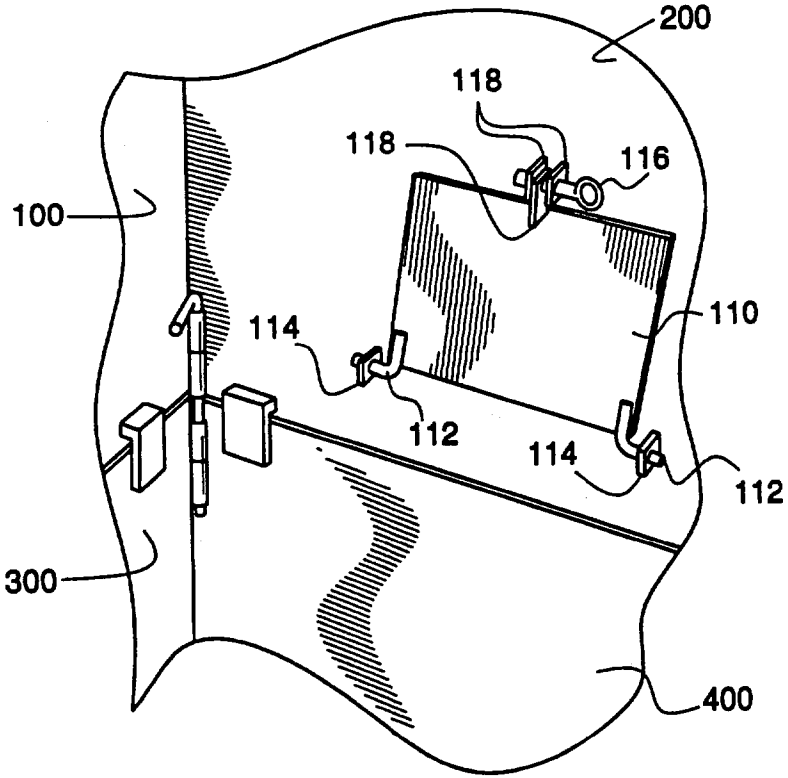
FIG. 3 is a detailed view of an exemplary ported panel according to this invention.

FIGS. 3 and 4 illustrate a detailed view of the ported panel 200. In particular, the ported panel 200 comprises an openable port 115 which is closable via door 110. The door 110 further comprises hinged portions 112 that cooperate with receivers 114 thereby allowing hinged opening and closing of the port 115. Furthermore, the door 110 can include a locking mechanism such as a pin 116 and receivers 118. However, it should be appreciated that other various locking and/or closure mechanisms can be used with equal success. For example, levers, knobs, clips, or the like, may be used.

FIG. 4 illustrates a detailed view of ported panel 200 with the door 10 illustrated in the open position. In this exemplary embodiment, door 110 is illustrated as a 2-part layered construction such that when the door 110 is in the closed position as illustrated in FIG. 3, the front-side of the door 110 is substantially planar in relation to the front-side of the ported plate 200.

Alternatively, the door 110 can be fixed by various means to the ported panel 200. For example, the door 110 can be held in place by a plurality of pin and receiver means such that when all pins are removed, the door 110 is capable of being detached from the panel 200. Furthermore, the location and orientation of the hinges and receivers can be varied to allow, for example, the door 110 to open in an upwards manner, or a sideways manner. Alternatively still, the door 110 can comprise a securing mechanism such that the door 110 can be opened and secured in a partially opened position.

Figure 5:
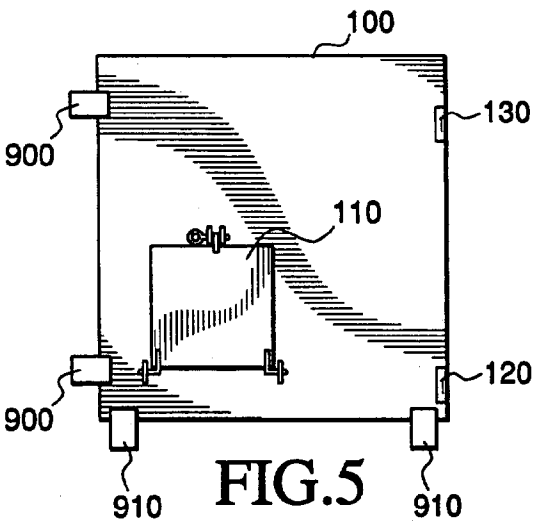
FIG. 5 illustrates an exemplary first ported panel according to this invention.

FIG. 5 illustrates an exemplary embodiment of the ported panel 100. The ported panel 100 comprises receivers 120 and 130, L-shaped flanges 900 and L-shaped flanges 910. In this exemplary embodiment, the L-shaped flanges 900 and 910 cooperates with the ported panel 100 to create a slot that accommodates the one or more adjoining panels. For example, in relation to ported panel 100, the L-shaped flanges 900 interlock with panel 500. In a similar fashion, the L-shaped flanges 910 interlock with panel 300.

Figure 6:
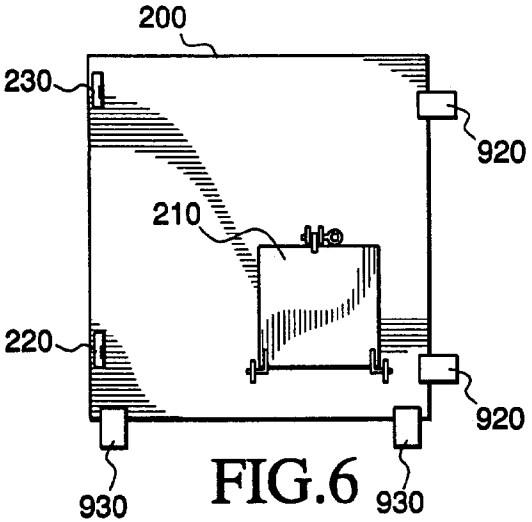
FIG. 6 illustrates an exemplary second ported panel according to this invention.

FIG. 6 illustrates an exemplary embodiment of the ported panel 200. In particular, the ported panel 200 comprises receivers 220 and 230, port 210, L-shaped flange 920 and L-shaped flange 930. In a similar fashion to ported panel 100, the L-shaped flanges 920 interlock with the adjoining panel 600 and the L-shaped flanges 930 interlock with adjoining panel 400.

Figure 7:
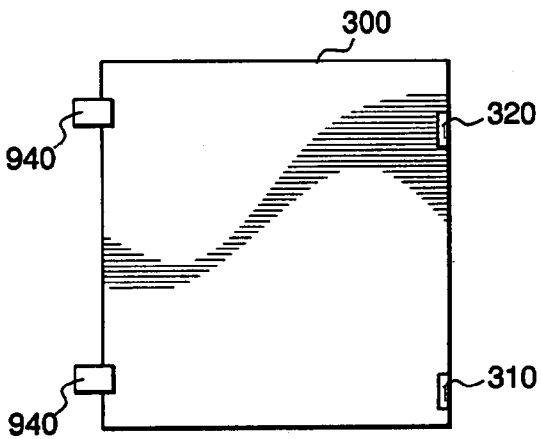
FIG. 7 illustrates an exemplary third panel according to this invention.

FIG. 7 illustrates an exemplary configuration of panel 300. In particular, panel 300 comprises receivers 310 and 320 and L-shaped flanges 940. The L-shaped flanges 940 interlock with adjoining panel 700.

Figure 8:
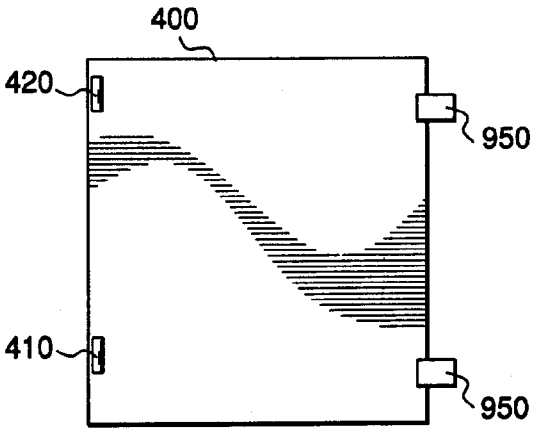
FIG. 8 illustrates an exemplary fourth panel according to this invention.

FIG. 8 illustrates an exemplary embodiment of panel 400. Panel 400 comprises receivers 410 and 420 and L-shaped flanges 950. The L-shaped flanges 950 interlock with the adjoining panel 800 when the mobile sentry station 10 is assembled.

Figure 9:
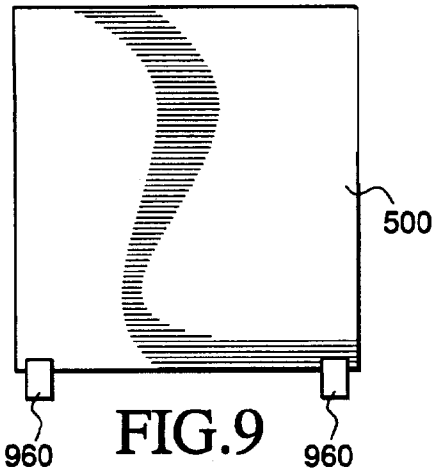
FIG. 9 illustrates an exemplary fifth panel according to this invention.

FIG. 9 illustrates and exemplary embodiment of panel 500 which is substantially similar to panel 600. Panel 500 comprises one or more L-shaped flanges 960 that interlock with panels 700 and 800, respectively.

Figure 10:
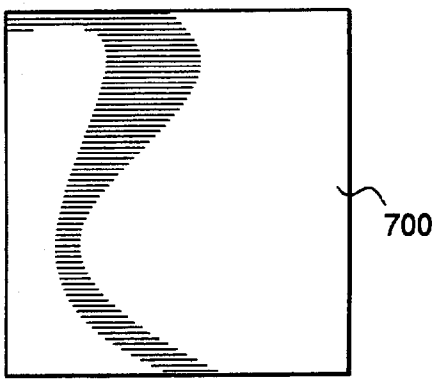
FIG. 10 illustrates an exemplary sixth panel according to this invention.

FIG. 10 illustrates an exemplary panel 700 which is substantially similar to panel 800. When the modular sentry station 10 is assembled, panel 700 and 800 are held in position by the L-shaped flanges of panels 500 and 600, respectively. Furthermore, panels 700 and 800 are held in position by the L-shaped flanges of panels 300 and 400, respectively.

Figure 11:
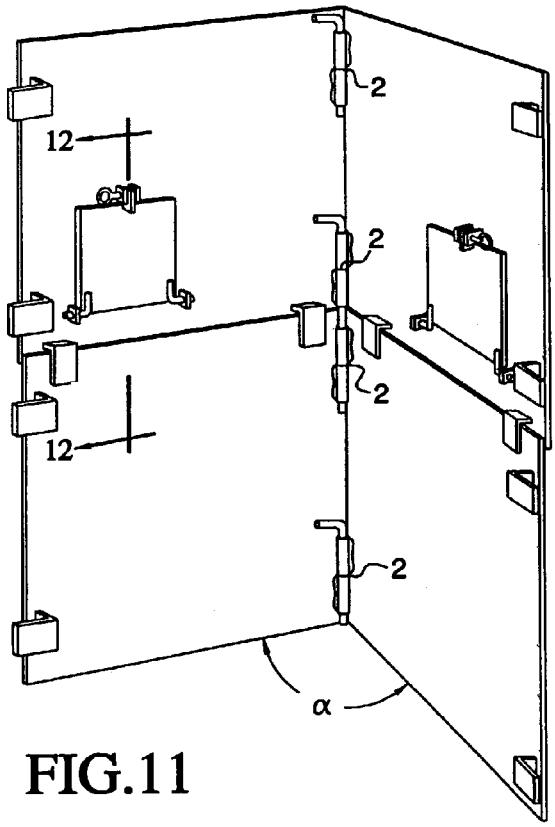
FIG. 11 illustrates partial back-side perspective view of an exemplary modular sentry station according to this invention.

FIG. 11 illustrates a partially assembled view of the modular sentry station 10. Alternatives to the previously disclosed embodiments for the interlocking mechanism 2 include a pivotal hinge assembly, a lock pin and receiver assembly, a retaining pin and receiver assembly, a tongue and groove assembly, or the like. It should be appreciated that any interlocking mechanism can be used for interlocking mechanisms 2 to provides a connection between ported panels 100 and 200, and panels 300 and 400. Furthermore, it is to be appreciated that the interlocking mechanism 2 need not be a pivotal interlocking mechanism, but can be a fixed interlocking mechanism that, for example, holds the opposing panels at a predetermined angle. Furthermore, it should be appreciated that the angle can exceed 180 degrees thereby allowing the modular sentry station 10 to be assembled in an inverted V configuration.

Figure 12:
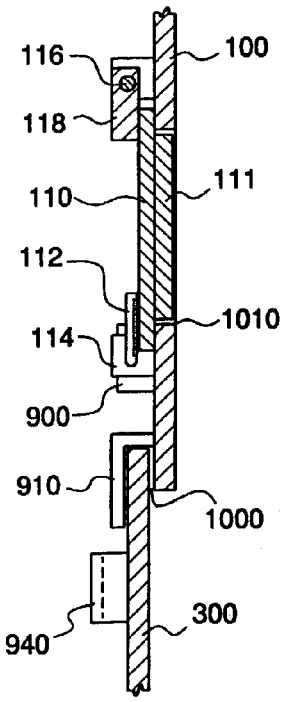
FIG. 12 illustrates a partial cross-sectional view of an exemplary modular sentry station taken along lines 12—12.

FIG. 12 is a partial cross-sectional view taken along lines 12—12. In particular, FIG. 12 illustrates the interaction of the L-shaped flanges and the accompanying panels to provide an interlocking slot 1000 into which adjoining panels are fitted. In particular, L-shaped flange 910 is attached to panel 100 thereby creating U-shaped slot 1000. The U-shape slot 1000 is thus a receiver that receives joining panel 300. Accordingly, it should be appreciated that the various L-shaped flanges can be varied in length and number and can also be combined into one elongated L-shaped flange. Additionally, as previously discussed, door 110 and panel 111 are configured such that when the door 110 is held in the closed position by pin 116 cooperating with receiver 118 and hinge 112 and receiver 114, the front panel 111 provides an essentially flat surface 1010 to the front-side of the modular sentry station 10.

It is, therefore, apparent that there has been provided, in accordance with the present invention, a portable sentry. While this invention has been described in conjunction with a number of embodiments, it is evident that many alternatives, modifications and variations would be or are apparent to those of ordinary skill in the applicable arts. Accordingly, the disclosure is intended to embrace all such alternatives, modifications, equivalents and variations that are within the spirit and scope of this invention.

The invention claimed is:

1. A modular bullet resistant sentry station comprising:

a first panel having a portion of an interlocking mechanism;

a second panel having a second corresponding portion of an interlocking mechanism, said second panel positioned adjacent to and overlapping a vertical edge of said first panel;

a securing mechanism securing the interlocking mechanism of said first panel and said second panel together; and at least one additional panel having an inside face and an outside face and positioned adjacent a horizontal edge of said first panel, with one of said inside face and said outside face of said additional panel overlapping and contacting a corresponding one of said inside face and said outside face of said first panel and including a positioning mechanism positioning said at least one additional panel with respect to said first panel;

wherein at least the first and second panels are securely interlock with one another for resisting the passing of bullets therethrough.

2. The station of claim 1, wherein said first panel and said second panel further comprise supplemental interlocking mechanisms that allow additional panels to be securely interlocked therewith.

3. The station of claim 1, wherein the modular sentry station comprising the panels is self supporting.

4. The station of claim 1, further comprising at least one ported panel having a positioning mechanism adapted to position said ported panel with respect to at least one of said first panel and said second panel.

5. The station of claim 1, further comprising at least one periphery panel having an interlocking mechanism adapted to interlock with at least one of said first panel, said second panel and said additional panel.

6. The station of claim 1, further comprising a ceiling element.

7. The station of claim 1, further comprising a floor element.

8. The station of claim 1, wherein the securing mechanism is a pin.

9. The station of claim 8, wherein the corresponding portions of the interlocking mechanisms are receivers for receiving said pin.

10. The station of claim 9, wherein there are at least two additional panels positioned adjacent on another with each of said additional panels including corresponding portions of at least a second interlocking mechanism.

11. The station of claim 10, wherein said pin is received in each of said corresponding interlocking mechanisms.

12. The station of claim 1, wherein the positioning mechanism is at least one of L-shaped flanges, interlocking slots, tongue and groove securing mechanisms and hinges.

13. The station of claim 12, wherein the first surface comprises two substantially planar surfaces in a substantially V-Shaped orientation.

14. The station of claim 1, wherein said first panel and said second panel form a substantially V-Shaped structure.

15. The station of claim 1, wherein the station provides a first surface that is substantially uniform with respect to ballistic penetrability.

16. The station of claim 1, wherein the first panel, second panel and additional panel are formed of at least one of AR500 steel, multilayered material including carbon fiber and Kevlar®.

17. A method of assembling a modular sentry station comprising:

securing a first panel to a second panel in a substantially V-shaped overlapping configuration, each of said first and second panels having an inside face and an outside face;

positioning a third panel adjacent to and overlapping a horizontal edge of said first panel, said third panel extending in substantially the same direction as said first panel and having an inside face in contact with said outside face of said first panel;

positioning a fourth panel adjacent to and overlapping a horizontal edge of said second panel and a vertical edge of said third panel and having an inside face in contact with said outside face of said second panel;

wherein the four panels create a substantially uniform V-shaped barrier, and allowing repeated assembly and disassembly of the sentry station such that when assembled, the modular sentry station resists the passing of bullets therethrough.

18. The method of claim 17, wherein said first panel, said second panel, said third panel and said fourth panel are formed of at least one of AR500 steel, multilayered material including carbon fiber and Kevlar®.

19. A method of assembling a modular bullet resistant sentry station comprising:

securing a first bullet resistant panel and a second bullet resistant panel in a substantially overlapping V-shaped configuration, each of said first and second bullet resistant panels having an inside face and an outside face;

positioning a third bullet resistant panel adjacent to and overlapping a horizontal edge of said first bullet resistant panel, said third bullet resistant panel extending in substantially the same direction as said first bullet resistant panel and having an inside face in contact with said outside face of said first bullet resistant panel;

positioning a fourth bullet resistant panel adjacent to and overlapping a horizontal edge of said second bullet resistant panel and a vertical edge of said third bullet resistant panel and having an inside face in contact with said outside face of said second panel;

wherein the four bullet resistant panels create a substantially uniform V-shaped barrier, and allowing repeated assembly and disassembly of the sentry station such that when assembled, the modular bullet resistant sentry station resists the passing of bullets therethrough.

20. The method of claim 19, further comprising the step of securing said third bullet resistant panel and said fourth bullet resistant panel to one another along their adjacent vertical edges.

21. The method of claim 19, wherein said first panel, said second panel, said third panel and said fourth panel are formed of at least one of AR500 steel, multilayered material including carbon fiber and Kevlar®.

* * * * *